US005588181A

United States Patent [19]

Sutton

[11] Patent Number: 5,588,181

[45] Date of Patent: Dec. 31, 1996

[54] HINGE FOR A GLASS SHOWER DOOR

[76] Inventor: Michael R. Sutton, 15745 E. Alta Vista Way, San Jose, Calif. 95127

[21] Appl. No.: 409,200

[22] Filed: Mar. 23, 1995

[51] Int. Cl.[6] ..... E05D 5/02

[52] U.S. Cl. ..... 16/252; 4/607; 4/557; 16/382; 16/390

[58] Field of Search ..... 16/252, 382, 388, 16/387, 389, 391, 390; 49/381, 501, 399; 4/607, 557, 614

[56] References Cited

U.S. PATENT DOCUMENTS

| | | | |
|---|---|---|---|
| 1,063,745 | 6/1913 | Sherman | 16/390 |
| 3,298,135 | 1/1967 | Kinser | 16/390 |
| 3,380,218 | 4/1968 | Fabich | 49/501 |
| 4,823,438 | 4/1989 | Roloff | 16/390 |
| 4,914,888 | 4/1990 | Hanson | 52/768 |
| 5,079,798 | 1/1992 | Burke et al. | 16/252 |
| 5,116,274 | 5/1992 | Artwohl et al. | 312/116 |
| 5,205,072 | 4/1993 | Eutebach | 16/235 |

OTHER PUBLICATIONS

Product Brochure; Glass Shower Door Product; Hiawatha, Inc.; 1994.

Product Brochure; Heavy Glass Pivot Door; Alumax Bath Enclosures.

Product Brochure; Shower Enclosures America Inc.

Fiat Metal Manufacturing Company, Bulletin No. 50, Issue II.

*Primary Examiner*—M. Rachuba
*Assistant Examiner*—Christopher Kirkman
*Attorney, Agent, or Firm*—Carol D. Titus; Leary, Titus & Aiello

[57] ABSTRACT

A hinge assembly having a strip shaped like a lower case h which attaches to a supporting surface and a generally U-shaped clamping member. The end of one of the legs of the clamping member attaches to the end of the top leg of the h. This attachment location forms the point of rotation of the hinge. The U-shaped strip has ribs down the inner sides of the legs. Along the base of the legs of the U, there are holes. To install, a sheet of glass is place in the slot formed by the legs of the U. A threaded screw is inserted through the holes in the first leg of the U. When the threads of the screw reach the hole on the opposed side, they engage the threads there. The screw is turned until the head of the screw reaches the base of the hole in the first side of the U. As turning continues, the screw begins pressing the legs of the U together. This presses the ribs firmly again the glass, thereby providing a firm hold on the glass.

20 Claims, 5 Drawing Sheets

HINGE FOR A GLASS SHOWER DOOR

FIELD OF INVENTION

The present invention relates to hinges. More particularly to a hinge for a glass shower door that also provides a labyrinth type barrier.

BACKGROUND OF THE INVENTION

As the years pass, glass is used more and more in both construction and in interior design. People want more light in the spaces they occupy. Glass has also become a decorating statement. Contemporary styles are filled with glass tables, enclosures, etc. Due to the increasing use of glass as a building material in other than standard window applications, there has been a call for new and improved ways of attaching to glass elements.

The standard method for installing glass is to provide a full frame around the edge of a glass sheet. Then any attachment is made to the framing material instead of to the glass itself. This makes attachment easy, but it requires that all the edges of the glass are covered. This style is quite appropriate for a window which is surrounded by wall anyway. However, in other applications where you have a glass enclosure, you may not want to have frames around each piece of glass. This would break the unobstructed wall of glass into sections interfering with the desired visual effect.

Other methods of attaching to glass require that holes or cut-outs be made in the sheet of glass. One such device is described in U.S. Pat. No. 5,079,798 to Burke et al. which teaches a glass hinge assembly. There is a clamping mechanism for attaching to a sheet of glass. The glass sheet is notched to receive a block which holds two clamping plates around the sheet of glass. A pin which the glass sheet rotates around is located within the block. This hinge assemble is attached to a fixed second assembly. There is a gap between the hinge assemble and the fixed assembly. This gap would make this hinge inappropriate for use where water could be sprayed against it, since there is no barrier to protect one side from water that may be located on the other side.

There are also other attachment methods which require that the glass be modified. Since glass can be very difficult to work with because of its fragile and brittle nature, it is far more advantageous to find a way to attach to the glass without requiring any modification to the glass itself.

U.S. Pat. No. 4,914,888 to Hanson discloses a support for a glass panel. This is a strip of material which is used on the top and bottom of a sheet of glass to secure the glass to the ceiling and floor. There is a clamping mechanism for frictionally engaging a sheet of glass. In the preferred embodiment, the device is H-shaped with the bridge of the H having a narrowed portion which allows for rotation of the sides. The sides of the H have ribs which when pressed together engage a sheet of glass. This device is intended for a rigid attachment and has no provision for a hinge or any way to rotate the glass sheet.

SUMMARY OF THE INVENTION

In keeping with the foregoing discussion, the objective of the present invention is to provide a hinge that may be easily attached to a sheet of material, especially brittle materials such as glass. Optimally, this attachment should be made without modification to the sheet of material.

A further objective of the present invention is to provide a hinge system that would provide a water barrier so that the hinge could be used for shower doors or in other water sensitive applications.

Another objective of the present invention is to provide a hinge where the operational parts of the hinge are less likely to accumulate dirt and other deposits.

In keeping with these objectives, the present invention takes the form of a strip shaped like a lower case h which attaches to a supporting surface and a generally U-shaped strip. The end of one of the legs of the U attaches to the end of the top leg of the h. This attachment location forms the point of rotation of the hinge. The U-shaped strip has ribs down the inner sides of the legs. Along the base of the legs of the U, there are holes. To install, a sheet of glass is place in the slot formed by the legs of the U. A threaded screw is inserted through the holes in the first leg of the U. When the threads of the screw reach the hole on the opposed side, it engages the threads there. The screw is turned until the head of the screw reaches the base of the hole in the first side of the U. As turning continues, the screw begins pressing the legs of the U together. This presses the ribs firmly again the glass, thereby providing a firm hold on the glass. Other objects and advantages of the invention will no doubt occur to those skilled in the art upon reading and understanding the following detailed description along with the accompanying drawings.

DETAILED DESCRIPTION OF THE INVENTION

Figure 1:
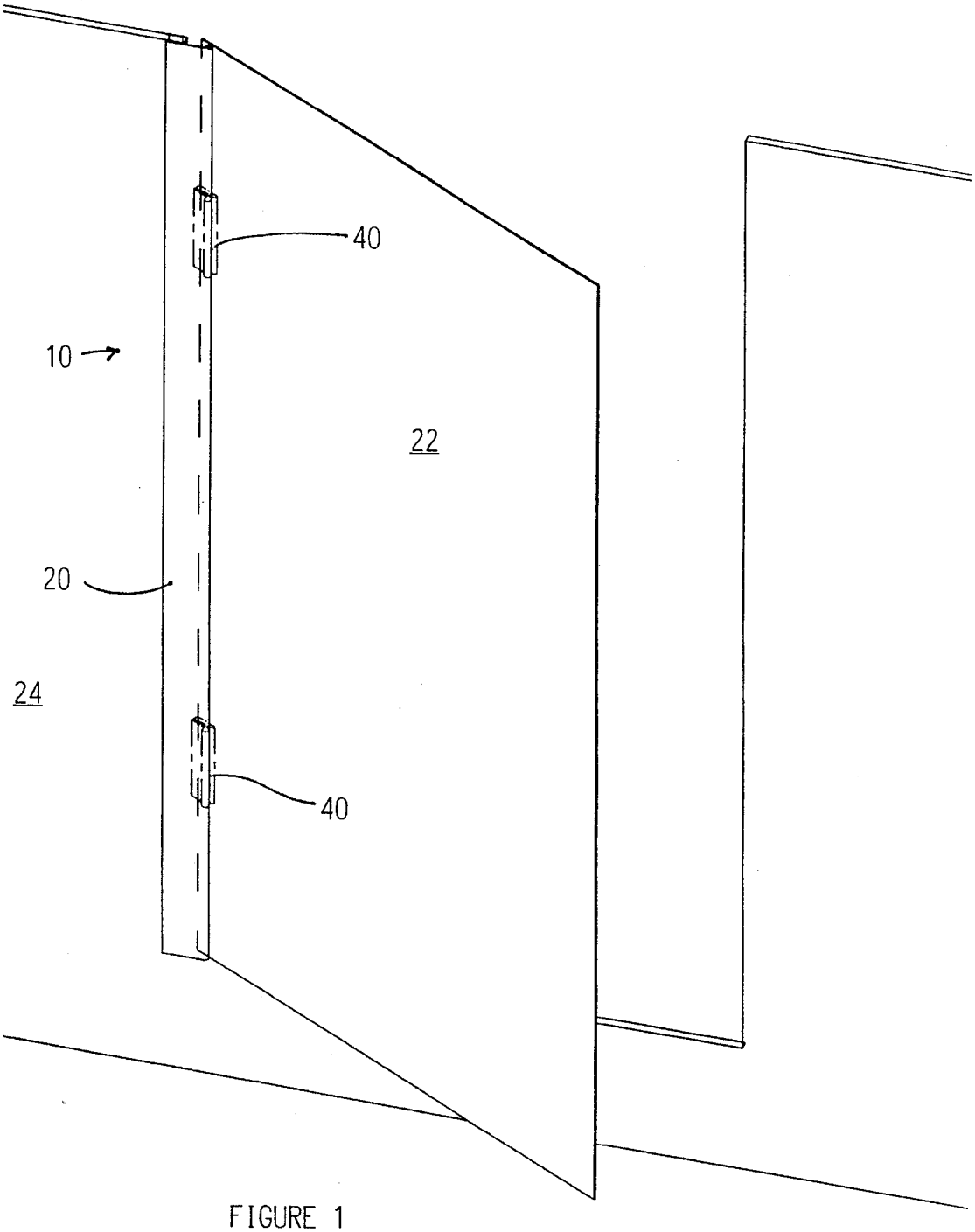
FIG. 1 is a perspective of a door installed with the hinge.

FIG. 1 is a perspective of the preferred embodiment of the hinge 10 used to install a glass shower door 22. The hinge 10 is formed of a strip 20 in the shape of a lower case h. This strip 20 attaches to a supporting wall 24. There are two U-shaped clamping members 40 which clamp onto a sheet of material, in this case a glass door 22. This allows the glass door 22 to cantilever out from the two clamping members 40, while still being firmly attached to the supporting wall 24. In most cases this attachment will be made with screws, but adhesive or other attachment means may be used. For holding the door shut, a standard latch member (not shown) may be attached to the glass sheet 22 opposite the hinge 10.

The hinge 10 may be constructed from any reasonably rigid, but slightly deformable material such as rigid plastics and metals. In the preferred embodiment, the hinge is extruded from aluminum. This allows the hinge 10 to very lightweight. Aluminum may also be anodized to provide a selection of colors.

Figure 2:
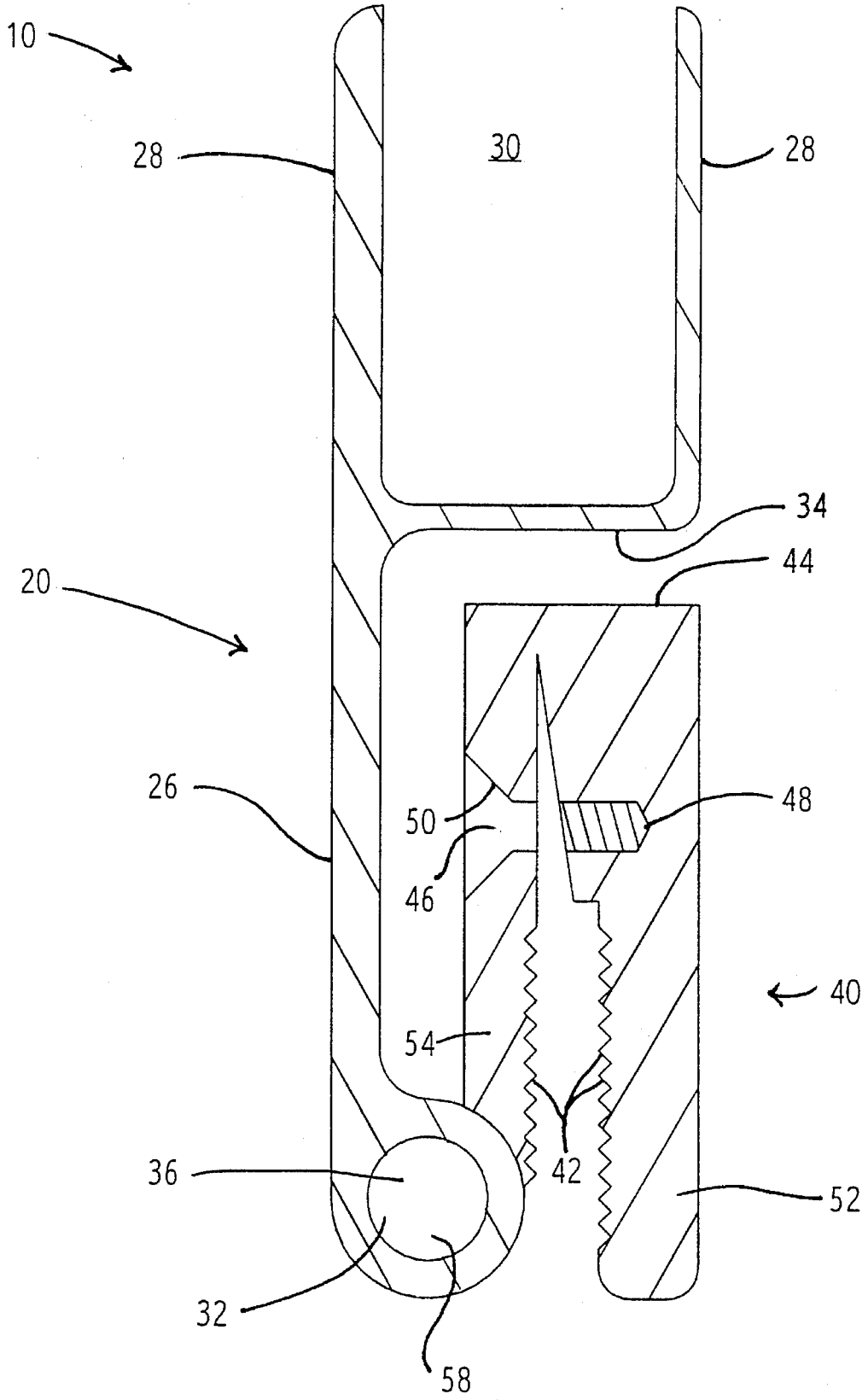
FIG. 2 is a cross section of the hinge.

FIG. 2 is a cross section of the hinge 10. The slot 30 formed by the legs 28 of the h-shaped strip 20 is attached to a support member 24 (see FIG. 1). One of the legs 52 of the U-shaped clamping member 40 is attached to the top end 26 of the h-shaped strip member 20 forming the point of rotation 32. On the insides of the legs 52, 54 of the clamping member 40 there are ridges 42. These ridges 42 provide multiple surfaces for engaging the sheet of glass 22. This provides a firmer grip than a smooth surface. Bumps and other geometries may be used to provide this grip. Toward the base 44 of the U of the clamping member 40, on the legs 52, 54, there are holes 46, 48. On one side the hole 46 passes all the way through the leg 54 and is smooth. Directly opposite, the other hole 48 goes part way through the other leg 52. This hole 48 is threaded to provide an appropriate surface for a screw to engage. A screw (not shown) is placed through the first hole 46 and begins to engage the threads in the second hole 48. The screw is turned until the head of the screw rests against the base 50 of the first hole 46. Turning is continued until the clamping member 40 has been deformed enough that the ridges 42 on the legs 52, 54 clamp firmly onto the glass 22.

Due to the configuration of the hinge 10, the glass of the shower door 22 overlaps the point of rotation 32 of the hinge 10 while the door 22 is closed. This creates a maze through which the water must pass to get outside the enclosure. This maze barrier has several advantages over ordinary hinged barriers. There is no possibility of water dribbling or passing through the hinge 10. This can become a problem with ordinary hinges, if the hinge is loose or becomes deformed during use. No extra seals are required around the hinges 10. Since the hinge 10 itself is never directly exposed to a stream of water or spray rebounding from an occupant, the hinge 10 remains cleaner and drier, will dry faster, and is therefore less likely to build up dirt, soap scum, salt deposits, or mildew and need cleaning. The only portions of the hinge 10 that are directly exposed to water, etc. are one leg 28 of the strip member 20 and the smooth front leg 52 of the clamping member 40. Indirectly, or by rebound, water may reach the members that are perpendicular to these, i.e. the base 44 of the clamping member 40 and the horizontal 34 of the h-shaped strip member 20. These portions are also smooth and are less prone to build up of debris and are easier to clean.

Figure 3:
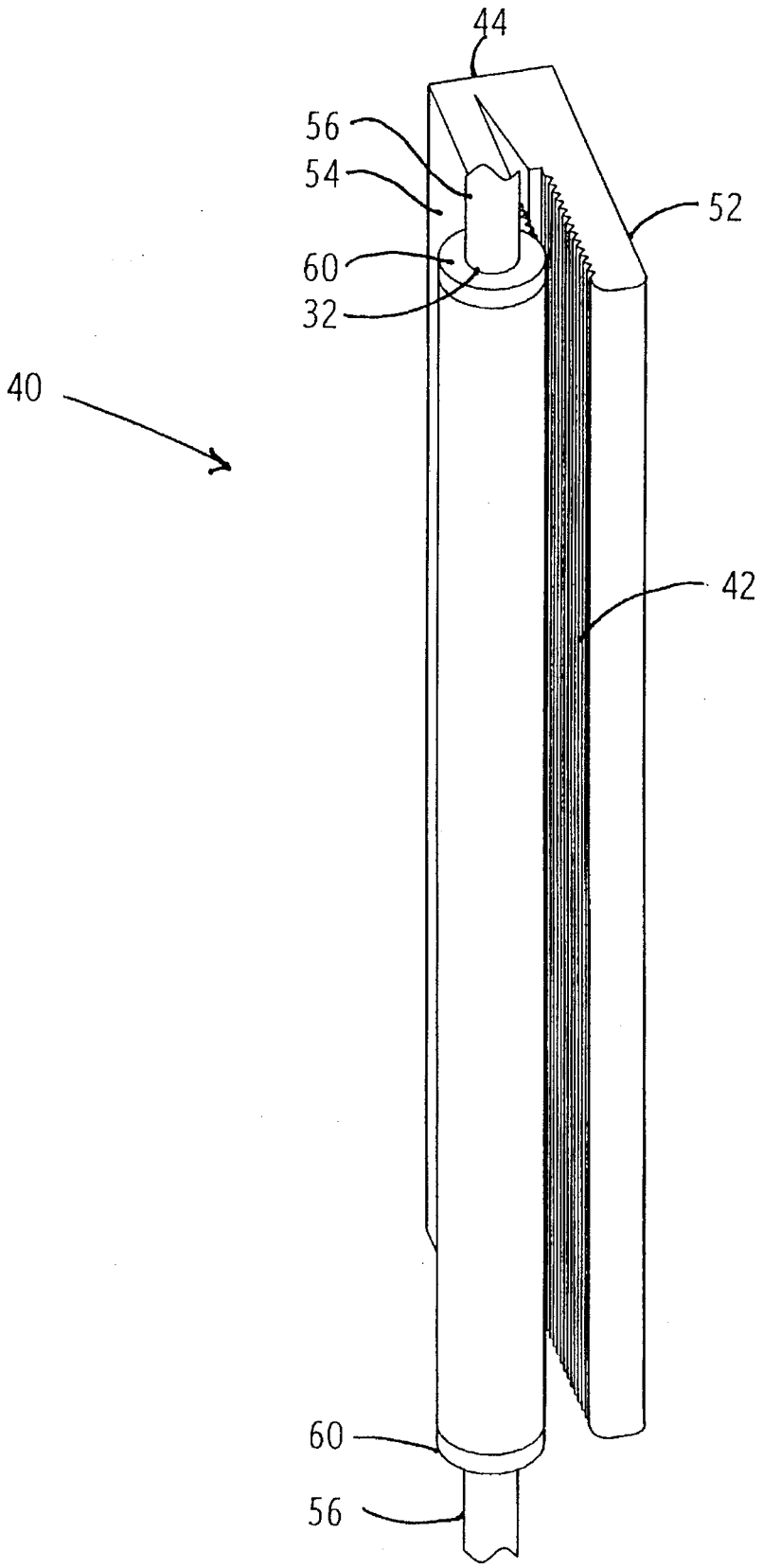
FIG. 3 is a perspective of the clamping member of the hinge.

FIG. 3 is a perspective of the clamping member 40 of the hinge 10. At the point of rotation 32 there is a channel 58 through which a pin 56 may be inserted. There is a corresponding channel 36 (see FIG. 2) in the h-shaped strip member 20. There is a cut-out section of this channel 36 so that the channel 58 of the clamping member 40 can be placed collinear with the channel 36 of the h-shaped strip 20. When the clamping members 40 have been attached to the sheet of material 22, the channel 58 of the clamping member 40 and the channel 36 h-shaped strip member 20 are lined up. The pin 56 is then inserted into the channels 36, 58 thereby holding the clamping member 40, and the glass door 22, in place. If longer clamping members 40 are desired or if an extremely heavy/wide door 22 is used it may be necessary to form multiple sections of the clamping member channel 58 and the strip channel 36. These sections of channel could then be interdigitated. This would be decrease the stresses in the pin 56 and minimize the chances that the pin 56 would become bent.

To aid in smooth operation of the hinge 10, a disk 60 is place on the top and bottom of the clamping member 40. The disk 60 has a hole through it matching the channels 36, 58 of the strip member 20 and the clamping member 40 and is located collinear with those channels 36, 58. The disk 60 provides a smoother and easier bearing surface for the hinge 10 to rest and turn against. In the preferred embodiment, the disk 60 is a plastic washer, but may also be formed of a hard rubber or any similar semi-resilient, low friction material.

Figure 4:
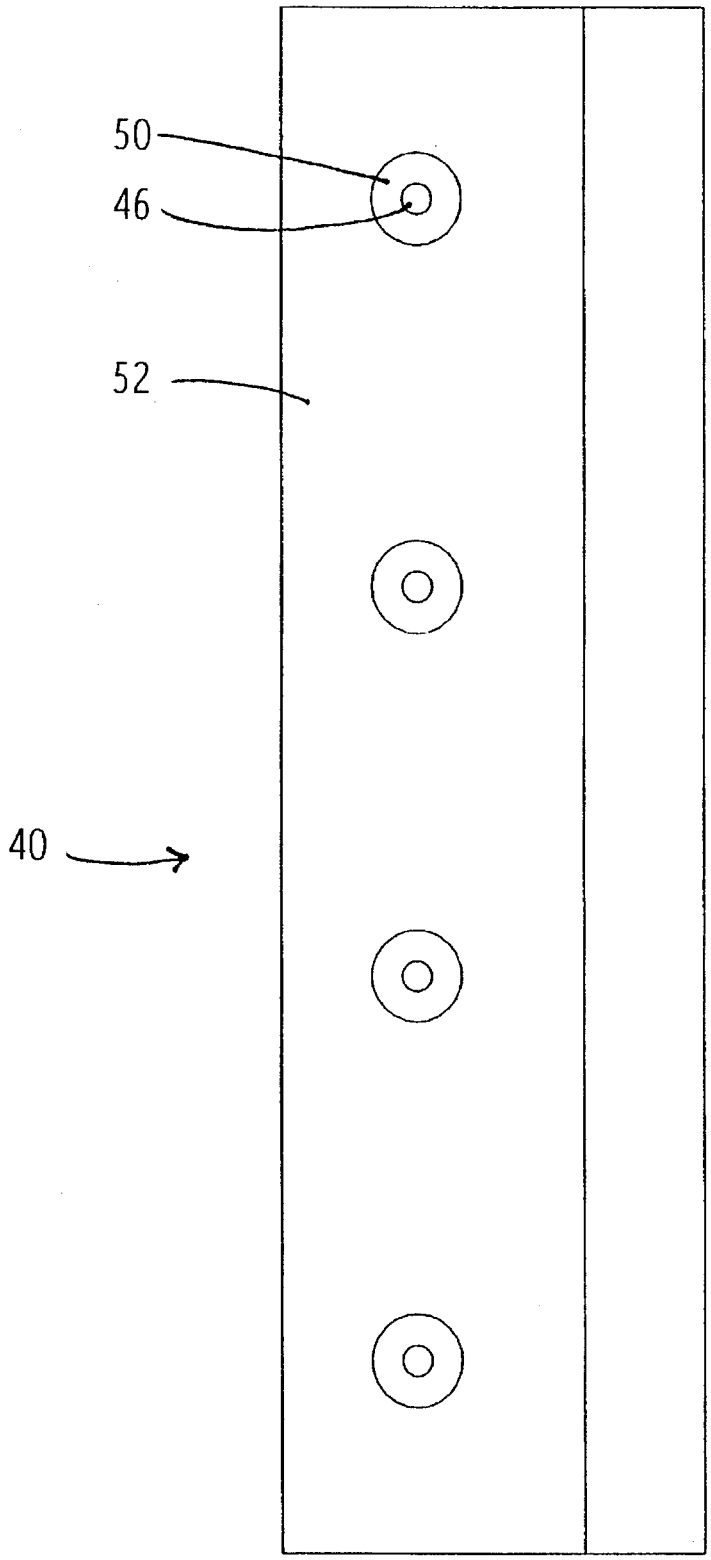
FIG. 4 is a back view of the clamping member of the hinge.

FIG. 4 is a back view of the clamping member 40 of the hinge 10. This shows the holes 46 passing through the back side 52 of the clamping member 40. This is the side of the clamping member 40 that would be facing the upper leg 26 of the strip member 20, therefore, the screws and their holes 46 would not be exposed to water and soap scum. As previously stated, this would decrease the frequency and difficulty of cleaning.

The hinge 10 allows the door 22 to be hung by two relatively small portions, the clamping members 40. This allows the door 22 to appear almost unconnected to the rest of the shower stall. This provides the openness and spaciousness that is often desired by today's contemporary styles.

Figure 5:
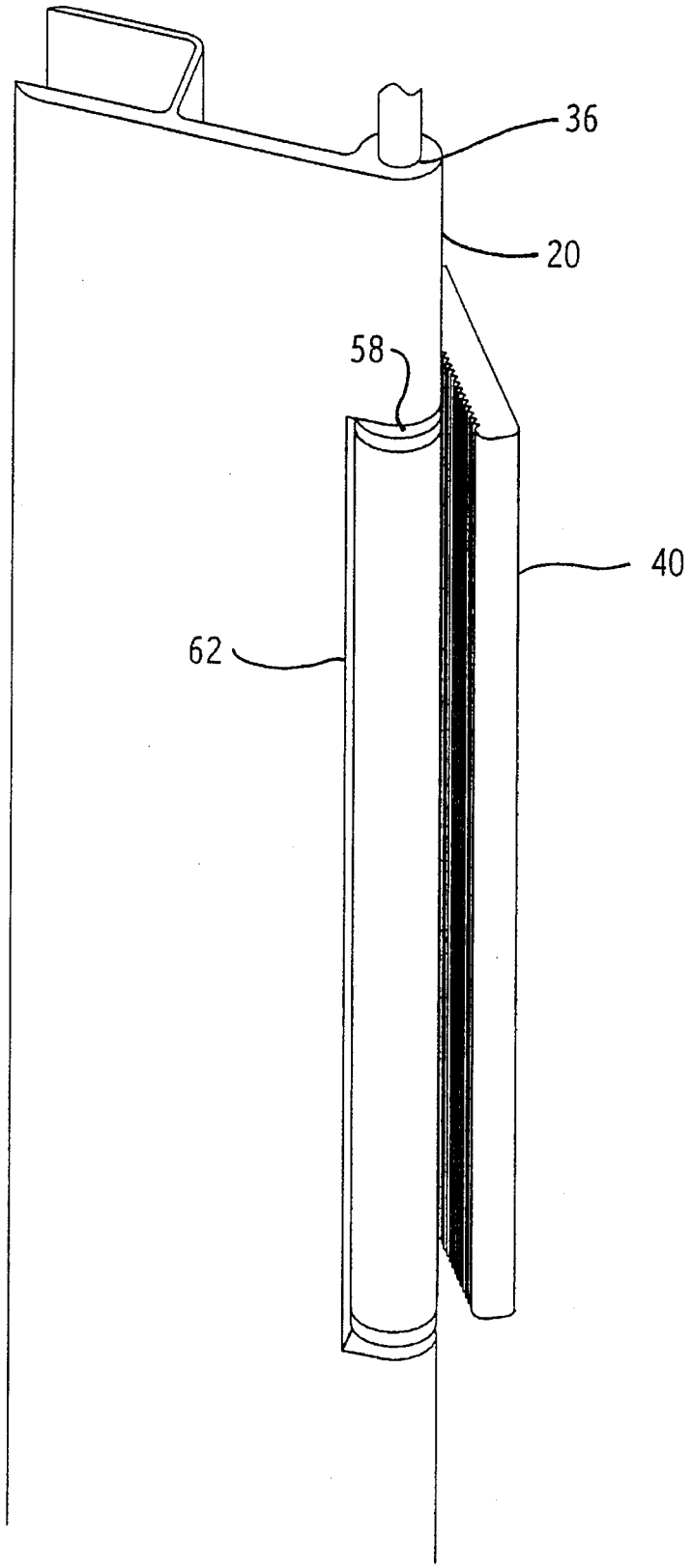
FIG. 5 is a perspective view of the hinge.

FIG. 5 is a perspective view of the hinge 10. The channel 58 of the clamping member 40 lines up with the cutout 62 in the channel 36 of the strip member 20. Once these channels 36, 58 have been lined up, the pin 56 may be inserted into the channels 36, 58, thereby interlocking the clamping member 40 and the strip member 20.

Although the examples given include many specificities, they are intended as illustrative of only one possible embodiment of the invention. Other embodiments and modifications will, no doubt, occur to those skilled in the art. For example the choice to use two clamping members was optional. Though not as stable one could use one clamp to hold the glass or several smaller clamping members could be used. Thus, the examples given should only be interpreted as illustrations of some of the preferred embodiments of the invention, and the full scope of the invention should be determined by the appended claims and their legal equivalents.

I claim:

1. A hinge, comprising:

at least one clamping member, said clamping member being generally U-shaped, said clamping member having a first leg and a second leg, said first leg having an end, a strip member, said strip member being generally shaped like a lower case h, said strip member having an upper leg, said upper leg having an end, and a point of rotation at which said end of said first leg of said clamping member is joined with said end of said upper leg of said strip member.

2. The hinge of claim 1 wherein said first and second legs of said clamping member have internal clamping surfaces, and said internal clamping surfaces have ridges.

3. The hinge of claim 1 further comprising:

at least one hole located in said first leg of said clamping member, said at least one hole being smooth, at least one hole located in said second leg of said clamping member, said at least one hole being threaded, and at least one screw sized to fit with said holes in said first and second legs of said clamping member.

4. The hinge of claim 1 wherein said at least one clamping member is two clamping members, said two clamping members being rotatably attached to said strip member.

5. The hinge of claim 1 wherein:

said ends of said first leg of said clamping member and said upper leg of said strip member have channels running through them, said end of said upper leg of said strip member has at least one section cut out such that said channel of said clamping member may be placed collinear with said channel of said strip member, and a pin sized to fit within said channels.

6. A door frame assembly, comprising:

a door, a door frame, and a hinge member comprising:

at least one clamping member, said clamping member being generally U-shaped, said clamping member having a first leg and a second leg, said first leg having an end, a strip member, said strip member being generally shaped like a lower case h, said strip member having an upper leg, said upper leg having an end, and an attachment means for attaching said end of said first leg of said clamping member to said end of said upper leg of said strip member, wherein said hinge rotatably attaches said door to said door frame.

7. The door frame assembly of claim 6 wherein said first and second legs of said clamping member have internal clamping surfaces, and said internal clamping surfaces have ridges.

8. The door frame assembly of claim 6 further comprising:

at least one hole located in said first leg of said clamping member, said at least one hole being smooth, at least one hole located in said second leg of said clamping member, said at least one hole being threaded, and at least one screw sized to fit with said holes in said first and second legs of said clamping member.

9. The door frame assembly of claim 6 wherein said at least one clamping member is two clamping members, said two clamping members being rotatably attached to said strip member.

10. The door frame assembly of claim 6 wherein said attachment means comprises:

a channel running through said end of said first leg of said clamping member, a channel running through said end of said upper leg of said strip member, said channel having at least one section cut out such that said channel of said clamping member may be placed collinear with said channel of said strip member, and a pin sized to fit within said channels.

11. A door frame assembly, comprising:

a door, a door frame, and a hinge member comprising:

at least one clamping member, said clamping member being generally U-shaped, said clamping member having a first leg and a second leg, said first leg having an end, said first and second legs of said clamping member have inside faces, and said inside faces have ridges, at least one hole located in said first leg of said clamping member, said at least one hole being smooth, at least one hole located in said second leg of said clamping member, said at least one hole being threaded, and at least one screw sized to fit with said holes in said first and second legs of said clamping member a strip member, said strip member being generally shaped like a lower case h, said strip member having an upper leg, said upper leg having an end, and an attachment means for attaching said end of said first leg of said clamping member to said end of said upper leg of said strip member, wherein said hinge rotatably attaches said door to said door frame.

12. The door frame assembly of claim 11 wherein said attachment means comprises:

a channel running through said end of said first leg of said clamping member, a channel running through said end of said upper leg of said strip member, said channel having at least one section cut out such that said channel of said clamping member may be placed collinear with said channel of said strip member, and a pin sized to fit within said channels.

13. The hinge of claim 1 wherein said hinge has a first position, and wherein, in said first position, said first leg of said clamping member is located adjacent said upper leg of said strip member.

14. The hinge of claim 13 wherein said second leg of said clamping member lies generally coplanar with a lower leg of said strip member.

15. The hinge of claim 13 wherein said hinge has an interior side, and in said first position said clamping member and said strip member block any direct line of travel toward said point of rotation from said interior side.

16. The hinge of claim 1 wherein said clamping member has a base, and wherein said first leg of said clamping member has a second end, said second end being attached to said base.

17. The hinge of claim 16 wherein said strip member has a lower leg, and wherein said upper leg has a second end, said second end of said upper leg being attached to said lower leg.

18. The door frame assembly of claim 6 wherein said clamping member has a base, and wherein said first leg of said clamping member has a second end, said second end being attached to said base.

19. The door frame assembly of claim 18 wherein said strip member has a lower leg, and wherein said upper leg has a second end, said second end of said upper leg being attached to said lower leg.

20. The door frame assembly of claim 11 wherein said clamping member has a base, and wherein said first leg of said clamping member has a second end, said second end being attached to said base, and wherein said strip member has a lower leg, and wherein said upper leg has a second end, said second end of said upper leg being attached to said lower leg.

* * * * *